US006508010B2

(12) United States Patent
Hanson et al.

(10) Patent No.: US 6,508,010 B2
(45) Date of Patent: Jan. 21, 2003

(54) DECK BOARD SPACER

(76) Inventors: John C. Hanson, 2194 W. Rainfall St., Meridian, ID (US) 83642; Daniel Larson, 2444 W. Rainfall St., Meridian, ID (US) 83642

( * ) Notice: Subject to any disclaimer, the term of this patent is extended or adjusted under 35 U.S.C. 154(b) by 4 days.

(21) Appl. No.: 09/828,725

(22) Filed: Apr. 9, 2001

(65) Prior Publication Data

US 2002/0144421 A1 Oct. 10, 2002

(51) Int. Cl.[7] ..... G01D 21/00
(52) U.S. Cl. ..... 33/613; 33/526; 33/DIG. 20
(58) Field of Search ..... 33/526, 527, 562, 33/563, 613, 645, DIG. 20

(56) References Cited

U.S. PATENT DOCUMENTS

| | | | | | |
|---|---|---|---|---|---|
| 387,284 | A | * | 8/1888 | Dupee | 33/562 |
| 489,584 | A | * | 1/1893 | Havener | 33/562 |
| 1,307,426 | A | * | 6/1919 | Wells | 33/562 |
| 2,509,441 | A | * | 5/1950 | MacAllan | 33/562 |
| 2,567,586 | A | * | 9/1951 | Werder | 33/562 |
| 2,686,959 | A | * | 8/1954 | Robinson | 33/613 |
| 3,735,497 | A | | 5/1973 | Boettcher | |
| 4,850,114 | A | | 7/1989 | Vockins | |
| 4,858,399 | A | | 8/1989 | Salato, Jr. | |
| 4,908,952 | A | | 3/1990 | Joos | |
| 4,930,225 | A | | 6/1990 | Phillips | |
| 4,953,341 | A | | 9/1990 | Joos | |
| 4,955,142 | A | | 9/1990 | Rieck | |
| 5,010,654 | A | | 4/1991 | Funes, Jr. | |
| 5,190,266 | A | | 3/1993 | Barrera | |
| 5,288,534 | A | | 2/1994 | Tavshanjian | |
| 5,293,694 | A | | 3/1994 | Swindle | |
| 5,359,783 | A | | 11/1994 | Smith | |
| 5,367,783 | A | | 11/1994 | Nygren | |
| 5,490,334 | A | * | 2/1996 | Payne | 33/613 |
| 5,560,117 | A | | 10/1996 | Tallman | |
| 5,603,195 | A | | 2/1997 | Cosentino | |
| 5,628,119 | A | * | 5/1997 | Bingham et al. | 33/613 |
| 5,768,793 | A | | 6/1998 | Fields | |
| 5,822,942 | A | * | 10/1998 | Lucia, Jr. | 33/645 |
| 5,930,974 | A | | 8/1999 | Zielinski | |
| 6,047,520 | A | | 4/2000 | Caraballo | |
| 6,385,859 | B1 | * | 5/2002 | Varney | 33/562 |

* cited by examiner

*Primary Examiner*—G. Bradley Bennett
(74) *Attorney, Agent, or Firm*—Stetina Brunda Garred & Brucker

(57) ABSTRACT

A deck spacer including a grip on the top portion, at least one aperture adjacent the upper portion and a slot formed adjacent its bottom edge to securely fit over a deck joist and allow adjacent deck boards to be easily and consistently spaced from one another during deck construction.

11 Claims, 2 Drawing Sheets

Fig. 1
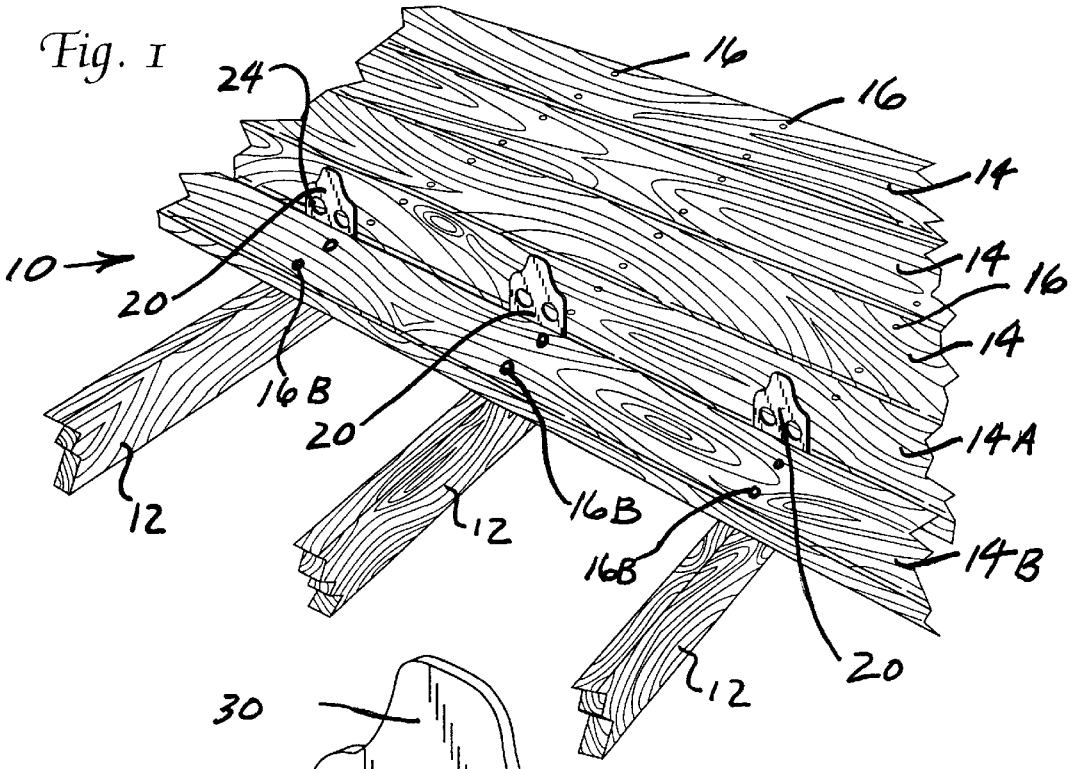
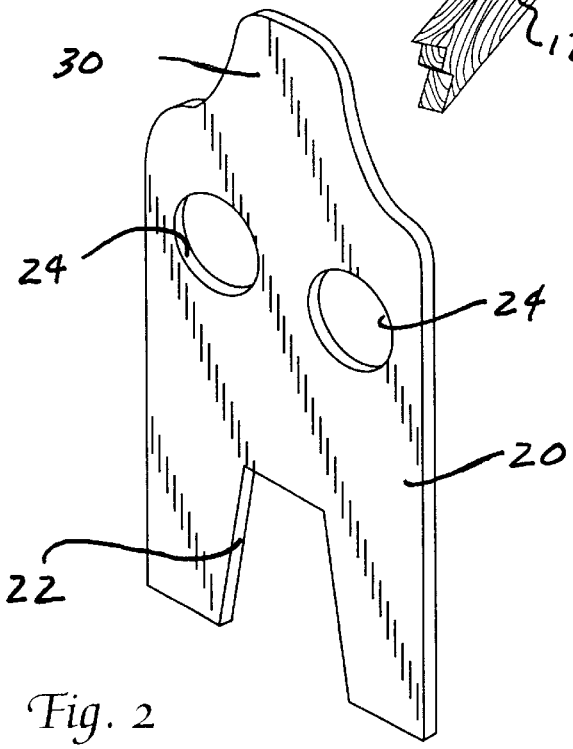
Fig. 2

DECK BOARD SPACER

BACKGROUND OF THE INVENTION

The present invention relates generally to the construction of outdoor decking and similar construction wherein it is desirable to achieve a uniform space width between adjacent pieces of lumber or similar building material.

Well known in the art is the usual method of construction of outdoor wood decks which requires the builder to employ spacing material such as wooden scraps, nails, pencils, and the like to achieve a uniform width between adjacent deck boards. The use of such spacing material is time consuming and often creates inconsistent spacing along the length of the decking boards. This spacing material is further ineffective due to the tendency of these items to fall between the joists during use, thereby requiring the builder to replace the spacing material or "eyeball" the width of the space. Further, removal of these types of spacing material can cause damage to the decking material upon removal of same. All of this, of course, wastes time, increases costs, and can cause inconsistent spacing of the deck boards.

Further with the increasing use of synthetic lumber material in the industry (e.g., Trex™, Choice Deck™, etc.) consistent spacing between boards becomes critical, since consistent spacing is typically required by synthetic lumber manufacturers for safety and warranty purposes.

Known in the art are the following patents which disclose devices which address consistent spacing of boards:

U.S. Pat. No. 3,735,497 (Boettcher) discloses a spacer for laying wooden flooring with a space between selected adjacent floor boards and maintaining said boards in a special relationship.

U.S. Pat. No. 4,850,114 (Vockins) discloses a decking spacer tool adapted for measured fitting between parallel boards prior to securing of the boards to a support.

U.S. Pat. No. 4,858,399 (Salato, Jr.) discloses a combination protective cover and spacer strip for mounting upon a wooden rectangular beam which supports horizontal planks.

U.S. Pat. No. 4,930,225 (Phillips) discloses a tool for use in marking, cutting, spacing, and/or securing boards or planks in deck, roof, or fence construction, and the like.

U.S. Pat. No. 4,955,142 (Rieck) discloses a hand tool for use in placing deck boards on a support structure.

U.S. Pat. No. 5,560,117 (Tallman) discloses a deck board or like spacer for establishing a predetermined space between a pair of deck boards.

While these above-referenced prior art patents all disclose devices utilized for providing consistent spacing between boards, and some additionally include some means to aid in removal of the device from the deck, none of these devices provide for a deck spacer that enables the builder to emplace the deck spacer prior to positioning the adjacent deck board, or a deck spacer comprising a lower notch sized to capture a portion of a joist therein, or the combination of one or more apertures and a grip, formed on the upper portion of the deck spacer to allow the same to be quickly emplaced and/or removed from the deck.

BRIEF SUMMARY OF THE INVENTION

The present invention specifically addresses the deficiencies of prior art spacing devices by enabling the builder to emplace the deck spacer prior to positioning the adjacent board, thereby speeding up the construction process, maintaining consistent spacing between boards, and allowing for easy, fast removal of the deck spacer for subsequent re-use.

More particularly, the present invention comprises a deck spacer which preferably includes a grip on the top portion thereof to aid in placement and removal of the deck spacer, at least one aperture to aid in the subsequent removal of the deck spacer from a deck, and a tapered slot formed along its bottom edge which slot fits over a conventional 2x and/or 4x joist board during construction. The slot formed on the bottom edge allows the spacer to securely fit over the deck joist allowing easy placement and removal while alleviating the problem of spacing material falling between joists. The ⅛" thickness of the deck spacer allows the installer to easily and consistently achieve the required spacing between deck boards as well as expedite the installation process. The deck spacer is preferably made of vinyl or like material which will not mar the boards.

The present invention provides an efficient means of ensuring a consistent space between deck boards, which at the same time provides for easy removal of the device. Accordingly, a primary object of the present invention is to provide a device which enables the builder to easily obtain a consistent space between deck boards. Thus, the deck spacer of the present invention allows both the novice and the professional to achieve a uniform decking surface with less effort and time.

Another object of the present invention is to provide a deck spacer which may be emplaced by the builder prior to laying down an adjacent board.

Another object of the present invention is to provide a deck spacer which securely fits over a joist.

A still further object of the present invention is to provide a deck spacer which allows for the use of multiple spacers to be used together on a single joist to achieve uniform spacing in ⅛ inch increments.

A further object of the present invention is to provide a deck spacer which has a grip to aid in placement, and removal of the deck spacer from the deck.

Still another object of the present invention is to provide a deck spacer which has one or more apertures for easy removal of the deck spacer from the deck.

Another object of the present invention is to provide a deck spacer which may be used by the builder as a wedge to cause curved and/or warped boards to move into closer parallel alignment with adjacent boards.

BRIEF DESCRIPTION OF THE DRAWINGS

These, as well as other features of the present invention, will become more apparent upon reference to the drawings wherein:

FIG. 1 is a perspective view of a deck under construction depicting the deck spacer as used in the construction of a deck in accordance with the present invention;

FIG. 2 is a front perspective view of the deck spacer in accordance with the present invention.

DETAILED DESCRIPTION OF THE INVENTION

Figure 3:
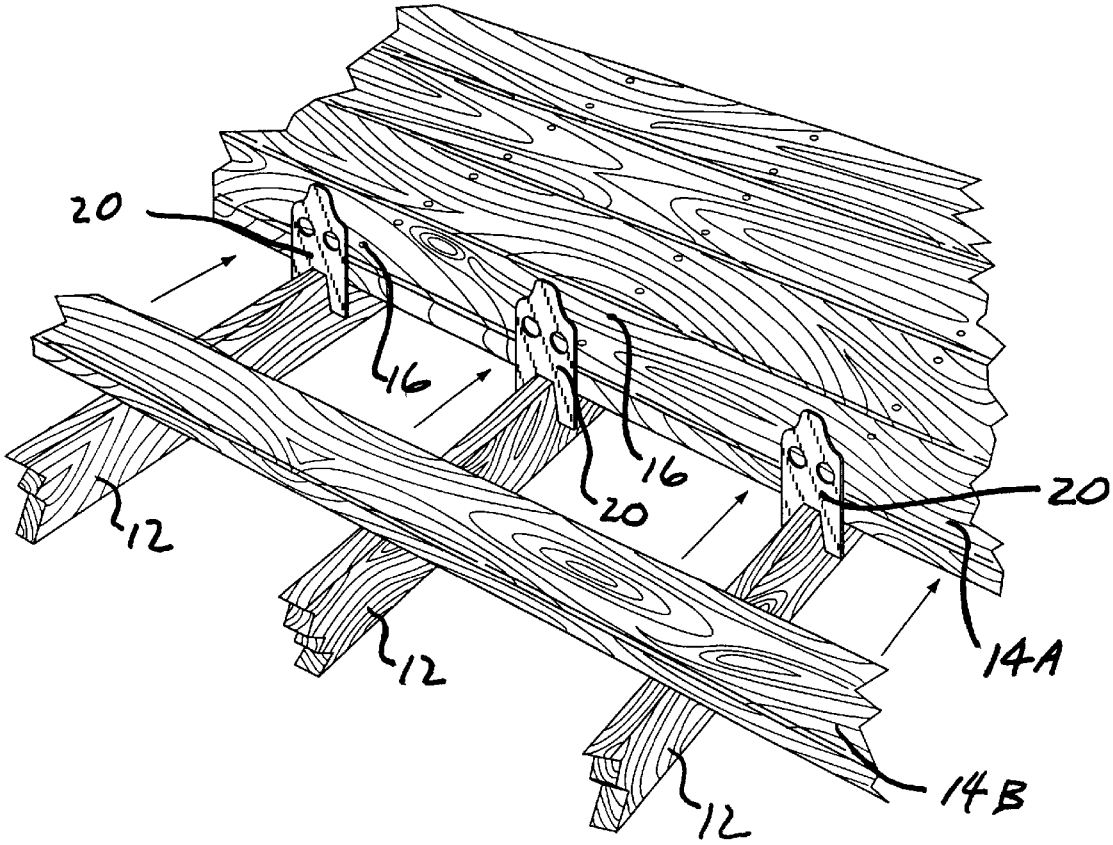
FIG. 3 is a perspective view of a deck under construction showing use of the deck spacer in an actuated position, in accordance with the present invention.

Referring now to the drawings wherein the showings are for purposes of illustrating a preferred embodiment of the present invention and not for purposes of limiting the same, an outdoor deck 10 under construction is depicted in FIG. 1. As is well unknown, the deck 10 is preferably formed by use of plural floor joists 12 which extend above ground being supported by suitable foundations (not shown). The joists 12 are typically formed from conventional 2x or 4x lumbar. Plural deck boards 14 are supported upon the top surface of the joists 12 and are secured thereto via suitable nail or screw fasteners 16 extending through the deck boards 14 and into the joists 12. As shown, it is preferred that adjacent deck boards 14 be slightly spaced from one another typically in the amount of approximately ⅛ of an inch to allow drainage of water therebetween, to allow for swelling of decking material and/or for proper ventilation of the area. The deck spacer 20 of the present invention is utilized to quickly and easily provide a consistent spacing or gap between adjacent deck boards 14.

Referring more particularly to FIG. 2, the deck board spacer 20 of the present invention which is depicted in the preferred embodiment is approximately 6 inches high by 4 inches wide and ⅛ inch in width. In the preferred embodiment, the deck spacer 20 is formed from a sheet material such as plastic, rubber, masonite, plywood, composite material or the like. The lower portion of the spacer 20 is provided with a tapered slot 22, the size of which is at least 1½ inches so as to be received over a conventional 2x joist. However, those skilled in the art will recognize that the tapered slot 22 can additionally be formed to accept a conventional 4x, 6x or 8x joist therein. A pair of apertures 24 are provided adjacent to the upper portion of the spacer 20 which are sized to receive a user's fingers therein. However, those skilled in the art will recognize that a single aperture or slot can additionally be provided in lieu of a pair of apertures 24. The upper end 30 functions to aid in the positioning and removal of the spacer 20.

Referring more particularly to FIG. 3, the use of the deck spacer 20 of the present invention is depicted. When a deck board 14A is secured to the joists 12 by plural fasteners 16, one or more deck spacers 20 may be positioned upon the joists 12 adjacent to the edge of the deck board 14A, as shown in FIG. 3. The spacers 20 may be manually pressed downwardly upon the joists 12 by manipulation of the upper end 30 of the spacer 20 wherein due to the tapered slot 22, the spacers 20 are captured or retained by friction upon the joists 12 so that they do not inadvertently fall therefrom. An adjacent deck board 14B may then be positioned upon the top surface of the joists 12 and manually slid in the direction of the arrows in FIG. 3 to contact the spacers 20. The deck board 14B may then be firmly pressed against the spacers 20 such that the adjacent edge of the deck board 14B is spaced from the adjacent edge of the deck board 14A by the width of the spacer, i.e., a consistent ⅛ of an inch. With the deck board 14B being pressed tightly against the spacer 20, plural fasteners 16B may be driven through the deck board 14B to secure the deck board 14B upon the joists 12.

As shown in FIG. 1, after the deck board 14B is secured to the joists 12, the plural apertures 24 formed in the spacers 20 extend vertically above the deck boards 14 such that a user may quickly insert a user's finger or fingers therewithin and subsequently manually pull upwardly to remove each of the spacers 20 from the joists 12. The upper end 30 may be gripped by the user, in addition to use of the apertures 24 for removal of the spacers 20. Subsequently, the spacers 20 may be repositioned upon the joists 12 for the next adjacent board. In this regard, the upper end 30 of the spacer 20 serves as a convenient hand-hold, enabling the spacers 20 to be rapidly positioned upon the joists 12 as previously described.

Additional modifications and improvements of the present invention may also be apparent to those of ordinary skill in the art, such as enlarging the deck spacer of the present invention to accommodate a 4x joist, or changing the thickness of the deck spacer to allow for a larger or smaller space between boards or tapering the bottom edge of the spacer to aid in placement when using the spacer as a wedge. Also contemplated herein is forming the deck spacer of extruded or molded material. Thus, the particular combination of parts described and illustrated herein is intended to represent only one embodiment of the present invention, and is not intended to serve as limitations of alternative devices within the spirit and scope of the invention.

What is claimed is:

1. A deck spacer for use in constructing a deck formed of plural joists and plural deck boards positioned upon and secured to the plural joists comprising:

an elongate generally planar member having a height and width and a slot formed along its lower edge sized to extend over said joist and maintain said member in a generally vertical orientation upon said joist such that the width of the planar member defines a gap between adjacent deck boards, wherein the height of the planar member is such that an upper end of the planar member protrudes above the plural deck boards so as to facilitate selective removal of the member from the joist.

2. The deck spacer of claim 1 wherein said slot comprises a tapered slot sized to extend over said joist and frictionally maintain said member upon said joist.

3. The deck spacer of claim 2 further comprising at least one aperture formed in said member adapted to provide a finger hole to selectively remove said member from said joist.

4. The deck spacer of claim 3 wherein at least one aperture comprises a pair of apertures located adjacent the upper end of said member.

5. The deck spacer of claim 1 wherein the upper end of said member includes a grip portion for positioning said member upon said joist.

6. The deck spacer of claim 2 wherein said tapered slot is sized to receive a 2x joist therein.

7. The deck spacer of claim 1 wherein said tapered slot is sized to receive a 4x joist therein.

8. The deck spacer of claim 1 wherein said member is formed of plastic.

9. The deck spacer of claim 1 wherein said member is formed of wood.

10. The deck spacer of claim 1 wherein said member is formed of rubber.

11. The deck spacer of claim 1 wherein said member is formed of a composite material.

* * * * *